US009812817B1

(12) United States Patent
Shirai et al.

(10) Patent No.: US 9,812,817 B1
(45) Date of Patent: Nov. 7, 2017

(54) ELECTRICAL CONNECTOR HAVING A MATING CONNECTOR INTERFACE

(71) Applicants: TE CONNECTIVITY CORPORATION, Berwyn, PA (US); TYCO ELECTRONICS JAPAN G.K., Kawasaki-shi (JP)

(72) Inventors: Hiroshi Shirai, Tokorozawa (JP); Chad William Morgan, Carneys Point, NJ (US); Masaaki Iwasaki, Yokohama (JP)

(73) Assignees: TE CONNECTIVITY CORPORATION, Berwyn, PA (US); TYCO ELECTRONICS JAPAN G.K., Kawasaki-Shi (JP)

( * ) Notice: Subject to any disclaimer, the term of this patent is extended or adjusted under 35 U.S.C. 154(b) by 0 days.

(21) Appl. No.: 15/417,449

(22) Filed: Jan. 27, 2017

(51) Int. Cl.

| | |
|---|---|
| ***H01R 13/648*** | (2006.01) |
| ***H01R 13/6586*** | (2011.01) |
| ***H01R 24/66*** | (2011.01) |
| *H01R 107/00* | (2006.01) |

(52) U.S. Cl.
CPC ..... *H01R 13/6586* (2013.01); *H01R 24/66* (2013.01); *H01R 2107/00* (2013.01)

(58) Field of Classification Search
CPC . H01R 24/66; H01R 13/6586; H01R 2107/00
See application file for complete search history.

(56) References Cited

U.S. PATENT DOCUMENTS

| | | | | |
|---|---|---|---|---|
| 6,843,687 | B2 | 1/2005 | McGowan et al. | |
| 6,899,566 | B2 * | 5/2005 | Kline | H01R 13/514 439/108 |
| 7,094,102 | B2 * | 8/2006 | Cohen | H05K 1/14 439/607.08 |
| 7,267,515 | B2 * | 9/2007 | Lappohn | H01R 13/514 439/607.07 |
| 7,344,391 | B2 * | 3/2008 | Minich | H01R 12/724 439/108 |
| 7,988,491 | B2 * | 8/2011 | Davis | H01R 13/6587 439/607.27 |
| 8,183,466 | B2 | 5/2012 | Morlion et al. | |
| 8,398,434 | B2 | 3/2013 | Davis et al. | |
| 8,444,434 | B2 | 5/2013 | Davis et al. | |
| 8,579,636 | B2 * | 11/2013 | Davis | H01R 12/7082 439/65 |
| 8,591,260 | B2 | 11/2013 | Davis et al. | |
| 8,690,604 | B2 | 4/2014 | Davis | |
| 8,771,017 | B2 | 7/2014 | Vino, IV et al. | |
| 8,777,663 | B2 | 7/2014 | Annis et al. | |

(Continued)

*Primary Examiner* — Briggitte R Hammond

(57) ABSTRACT

An electrical connector includes a housing having a base with signal and ground contact openings therethrough and contact modules coupled to the base. Each contact module includes a dielectric holder holding signal contacts having mating portions received in corresponding signal contact openings and extending into a chamber for mating with a mating electrical connector. A ground shield is coupled to the dielectric holder having a plurality of rails. At least two of the rails have ground hoods extending forward of the mating end of the dielectric holder along the mating portions of the signal contacts. The ground hoods are received in corresponding ground contact openings and extend into the chamber for mating with the mating electrical connector.

20 Claims, 6 Drawing Sheets

(56) References Cited

U.S. PATENT DOCUMENTS

| | | | | |
|---|---|---|---|---|
| 8,992,252 | B2 | 3/2015 | McClellan et al. | |
| 9,331,407 | B2 | 5/2016 | Laurx et al. | |
| 9,515,429 | B2 * | 12/2016 | De Geest | H01R 23/005 |
| 9,548,570 | B2 * | 1/2017 | Laurx | H01R 13/41 |
| 9,685,736 | B2 * | 6/2017 | Gailus | H01R 13/6585 |
| 2012/0135641 | A1 * | 5/2012 | Okuyama | H01R 4/027 439/626 |
| 2016/0181732 | A1 | 6/2016 | Laurx et al. | |

* cited by examiner

ELECTRICAL CONNECTOR HAVING A MATING CONNECTOR INTERFACE

BACKGROUND OF THE INVENTION

The subject matter herein relates generally to electrical connectors having signal contacts and ground shields.

Some electrical systems utilize electrical connectors to interconnect two circuit boards, such as a motherboard and daughtercard. In various known systems, a midplane assembly is provided between the electrical connectors to provide mating interfaces for interconnecting both electrical connectors. For example, header connectors are mounted to opposite sides of a midplane circuit board to form the midplane assembly, where one of the electrical connectors is mated with one of the header connectors and the other electrical connector is mated with the other header connector. Such systems are complicated and provide additional components in the form of the midplane circuit board and the pair of header connectors, which adds cost and complexity to the overall system.

Other known systems provide adapter connectors between the electrical connectors. For example, the electrical connectors may both define receptacle connectors having receptacle contacts at the mating interfaces thereof. A header adaptor connector is provided between the electrical connectors and may be mounted directly to the mating end of one of the electrical connectors. The header adapter connector provides a second mating interface for the other electrical connector. The header adapter connector provides pin contacts at both the first and second mating interfaces for electrically connecting to both electrical connectors. However, such systems require the use of the special header adapter connector, adding cost and additional mating interfaces along the signal paths.

Other known systems have one of the electrical connectors designed with pin contacts and the other electrical connector designed with receptacle contacts. However, to provide shielding along the signal paths, separate ground shields are mounted into a housing for electrical connection to the first and second electrical connectors. Assembly of the ground shields and electrical connection of each of the ground shields is difficult.

A need remains for an electrical connector system having a robust and reliable mating interface that provides electrical shielding for the signal contacts of the electrical connectors.

BRIEF DESCRIPTION OF THE INVENTION

In one embodiment, an electrical connector is provided including a housing having a front and a rear opposite the front with a chamber at the front for receiving a mating electrical connector. The housing has a base at the rear defining a back of the chamber including signal contact openings and ground contact openings therethrough. The electrical connector also includes a contact module stack having a plurality of contact modules coupled to the base and extending rearward from the rear of the housing. Each contact module includes a dielectric holder holding signal contacts having mating portions extending from a mating end of the dielectric holder, mounting portions extending from a mounting end of the dielectric holder for termination to a circuit board, and transition portions between the mating and mounting portions. The mating portions are received in corresponding signal contact openings and extend into the chamber for mating with the mating electrical connector. A ground shield is coupled to the dielectric holder and provides electrical shielding for the signal contacts. The ground shield has a plurality of rails configured to be aligned with the transition portions of corresponding signal contacts. At least two of the rails have ground hoods extending forward of the mating end of the dielectric holder along the mating portions of the signal contacts. The ground hoods are received in corresponding ground contact openings and extend into the chamber for mating with the mating electrical connector.

In another embodiment, an electrical connector is provided including a housing having a front and a rear opposite the front. The housing has a chamber at the front for receiving a mating electrical connector and a base at the rear defining a back of the chamber. The base has signal contact openings and ground contact openings therethrough. The electrical connector includes a contact module stack having a plurality of contact modules coupled to the base and extending rearward from the rear of the housing. Each contact module includes a dielectric holder having first and second sides extending between a mating end and a mounting end. Each contact module includes signal contacts held by the dielectric holder along a contact plane defined between the first and second sides. The signal contacts have mating portions extending from the mating end, mounting portions extending from the mounting end for termination to a circuit board, and transition portions extending through the dielectric holder between the mating and mounting portions. The mating portions are received in corresponding signal contact openings and extend into the chamber for mating with the mating electrical connector. Each contact module includes guard traces being held by the dielectric holder along the contact plane between corresponding signal contacts that electrically common and providing electrical shielding between the corresponding signal contacts. Each contact module includes a ground shield coupled to the first side of the dielectric holder and providing electrical shielding for the signal contacts. The ground shield is electrically connected to each of the guard traces. The ground shield has a plurality of rails for electrically shielding corresponding signal contacts. Each of the rails have side strips configured to be aligned with the transition portions of corresponding signal contacts along the first side. Each of the rails have connecting strips extending inward from the side strips into the dielectric holder to directly engage the corresponding guard traces. At least two of the rails have ground hoods extending along the mating ends of the signal contacts. The ground hoods are received in corresponding ground contact openings and extend into the chamber for mating with the mating electrical connector.

In a further embodiment, an electrical connector is provided including a housing having a front and a rear opposite the front with a chamber at the front for receiving a mating electrical connector and a base at the rear defining a back of the chamber having signal contact openings and ground contact openings therethrough. The electrical connector also includes a contact module stack having a plurality of contact modules coupled to the base and extending rearward from the rear of the housing. Each contact module includes a dielectric holder having first and second sides extending between a mating end and a mounting end with signal contacts and guard traces held by the dielectric holder along a contact plane defined between the first and second sides. The signal contacts have mating portions extending from the mating end, mounting portions extending from the mounting end for termination to a circuit board, and transition portions extending through the dielectric holder between the mating and mounting portions. The mating portions are received in corresponding signal contact openings and extending into the chamber for mating with the mating electrical connector. The guard traces are electrically commoned and provide electrical shielding between the corresponding signal contacts. Each contact module includes a first ground shield coupled to the first side of the dielectric holder and providing electrical shielding for the signal contacts. The first ground shield is electrically connected to each of the guard traces. The first ground shield has a plurality of rails for electrically shielding corresponding signal contacts, where the plurality of rails include, in order, a first rail, a second rail and a third rail. Each of the rails have side strips configured to be aligned with the transition portions of corresponding signal contacts along the first side. The first and third rails have ground hoods extending along the mating ends of the signal contacts and the second rail does not include a ground hood. Each contact module includes a second ground shield coupled to the first side of the dielectric holder and providing electrical shielding. The second ground shield has a ground hood extending forward of the second rail. The second rail is terminated to the ground hood of the second ground shield. The ground hood associated with the first rail is a first ground hood, the ground hood of the second ground shield associated with the second ground rail is a second ground hood, and the ground hood associated with the third rail is a third ground hood. The second ground hood is positioned between the first and the third ground hoods. The first, second and third ground hoods are received in corresponding ground contact openings and extending into the chamber for mating with the mating electrical connector.

DETAILED DESCRIPTION OF THE INVENTION

Figure 1:
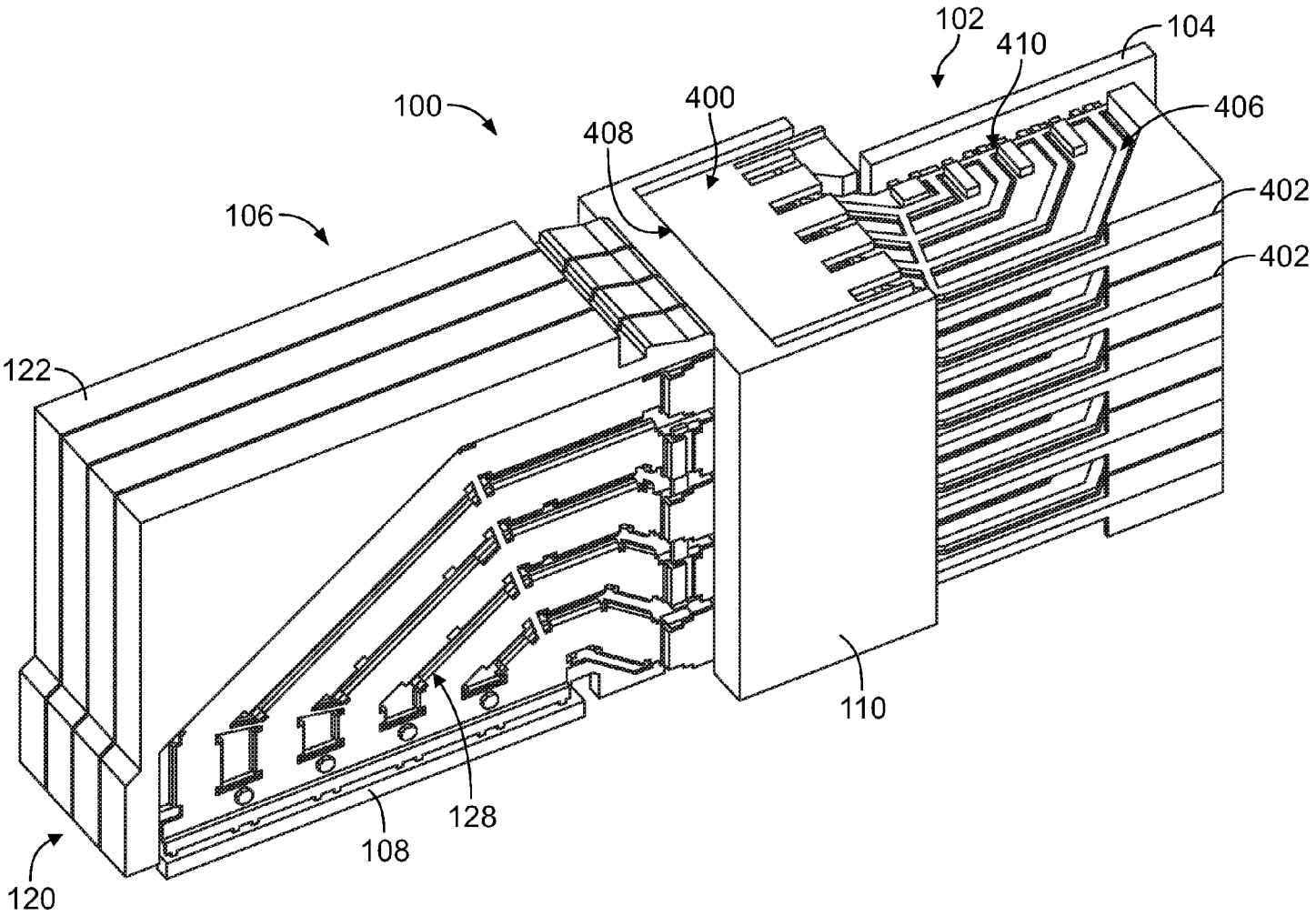
FIG. 1 is a perspective view of an electrical connector system formed in accordance with an exemplary embodiment showing electrical connectors in a mated state.
Figure 2:
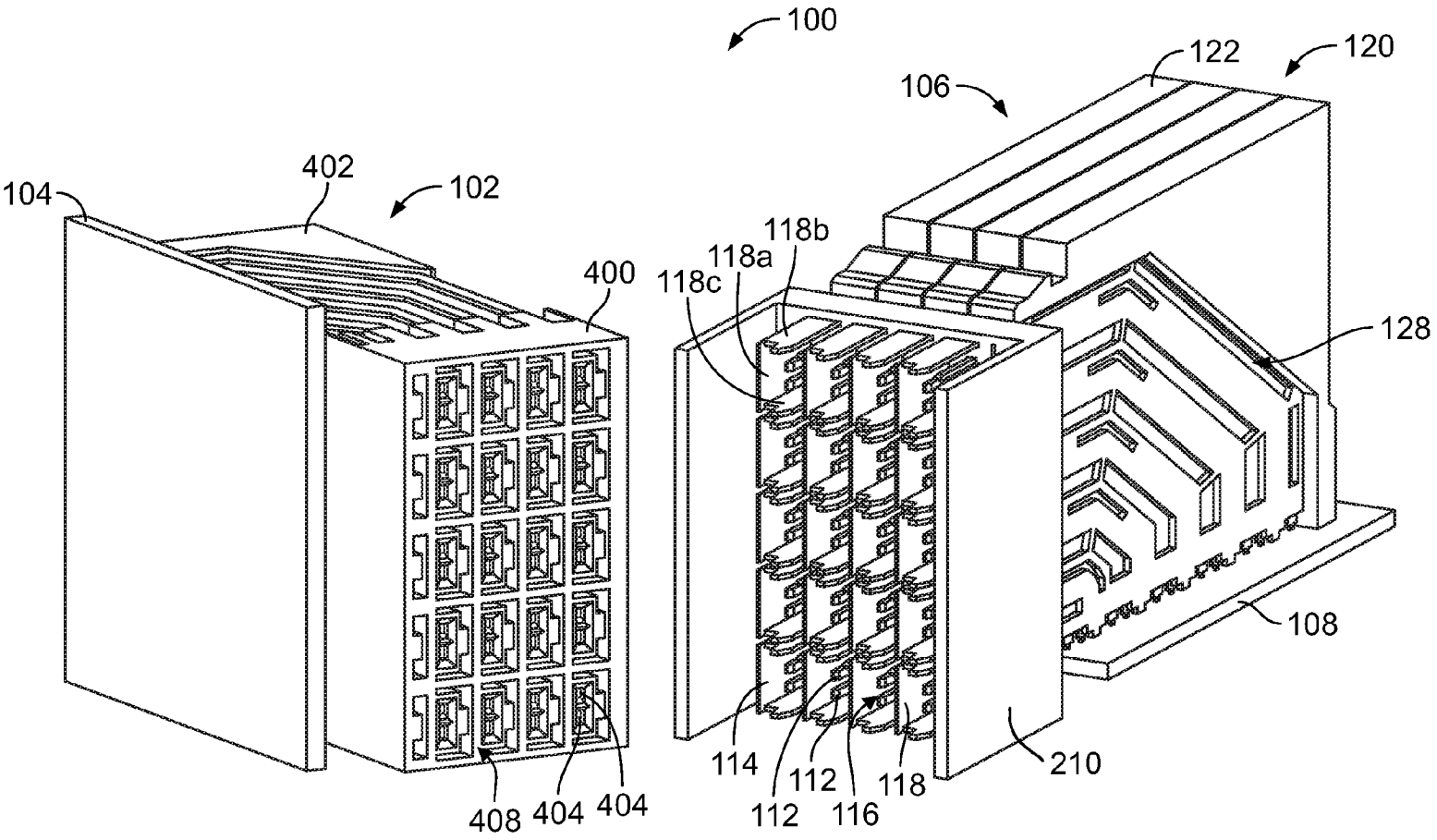
FIG. 2 is a front perspective view of the electrical connector system showing the electrical connectors in an unmated state.

FIG. 1 is a perspective view of an electrical connector system 100 formed in accordance with an exemplary embodiment showing electrical connectors 102, 106 in a mated state. FIG. 2 is a front perspective view of the electrical connector system 100 showing the electrical connectors 102, 106 in an unmated state. The electrical connector 102 is mounted to a circuit board 104 and the electrical connector 106 is mounted to a circuit board 108. The electrical connectors 102, 106 define mating electrical connectors complementary to each other to create electrical paths between the circuit boards 104, 108.

In an exemplary embodiment, the electrical connector 106 defines a header connector and the electrical connector 102 defines a mating electrical connector or a receptacle connector for the electrical connector 106. Various types of connector assemblies may be used in various embodiments, such as a right angle connector, a vertical connector or another type of connector. However, in the illustrated embodiment, the electrical connectors 102, 106 are right angle connectors and are designed such that the circuit boards 104, 108 are oriented orthogonal to each other (for example, the circuit board 104 is oriented vertically while the circuit board 108 is oriented horizontally).

The electrical connector 106 includes a housing 110 holding a plurality of signal contacts 112 and ground hoods 114. The signal contacts 112 may be arranged in pairs 116. Each ground hood 114 extends around corresponding signal contacts 112, such as one of the pairs 116 of signal contacts 112. In the illustrated embodiment, the ground hoods 114 are C-shaped having walls 118, such as a center wall 118*a* and a pair of end walls 118*b*, 118*c* extending from opposite ends of the center wall 118*a*. The ground hoods 114 surround the corresponding signal contacts 112 on three sides thereof. For example, the walls 118, in the illustrated embodiment, extend along one side of the corresponding pair 116 of signal contacts 112, as well as the top and the bottom of the corresponding pair 116 of signal contacts 112; however, other orientations are possible in alternative embodiments. An adjacent ground hood 114 provides electrical shielding across the open side of the ground hood 114. As such, the pairs 116 of signal contacts 112 are circumferentially surrounded on all four sides by the ground hoods 114.

The electrical connector 106 includes a contact module stack 120 coupled to the housing 110. The contact module stack 120 includes a plurality of contact modules 122 arranged side-by-side generally parallel to one another. The contact modules 122 may be loaded into the housing 110 or otherwise coupled to the housing 110. Any number of contact modules 122 may be provided in the electrical connector 106.

The mating electrical connector 102 includes a housing 400 that holds a plurality of contact modules 402. The contact modules 402 are held in a stacked configuration generally parallel to one another. The contact modules 402 may be loaded into the housing 400 side-by-side in the stacked configuration as a unit or group. Any number of contact modules 402 may be provided in the electrical connector 102. The contact modules 402 each include a plurality of signal contacts 404 (shown in FIG. 2) that define signal paths through the electrical connector 102. The signal contacts 404 are configured to be electrically connected to corresponding mating signal contacts 112 of the mating electrical connector 106.

The electrical connector 102 includes a mating end 408, such as at a front of the electrical connector 102, and a mounting end 410, such as at a bottom of the electrical connector 102. In the illustrated embodiment, the mounting end 410 is oriented substantially perpendicular to the mating end 408. The mating and mounting ends 408, 410 may be at different locations other than the front and bottom in alternative embodiments. The signal contacts 404 extend through the electrical connector 102 from the mating end 408 to the mounting end 410 for mounting to the circuit board 104.

The signal contacts 404 are received in the housing 400 and held therein at the mating end 408 for electrical termination to the electrical connector 106. The signal contacts 404 are arranged in a matrix of rows and columns. In the illustrated embodiment, at the mating end 408, the rows are oriented parallel to the circuit board 104, and the columns are oriented perpendicular to the circuit board 104. Other orientations are possible in alternative embodiments. Any number of signal contacts 404 may be provided in the rows and columns. Optionally, the signal contacts 404 may be arranged in pairs carrying differential signals; however other signal arrangements are possible in alternative embodiments, such as single ended applications. Optionally, the pairs of signal contacts 404 may be arranged in columns (pair-in-column signal contacts). Alternatively, the pairs of signal contacts 404 may be arranged in rows (pair-in-row signal contacts). The signal contacts 404 within each pair may be contained within the same contact module 402.

In an exemplary embodiment, each contact module 402 has a shield structure 406 (shown in FIG. 1) for providing electrical shielding for the signal contacts 404. The shield structure 406 is configured to be electrically connected to the ground hoods 114 of the mating electrical connector 106. The shield structure 406 may provide shielding from electromagnetic interference (EMI) and/or radio frequency interference (RFI), and may provide shielding from other types of interference as well to better control electrical characteristics, such as impedance, cross-talk, and the like, of the signal contacts 404. The contact modules 402 provide shielding for each pair of signal contacts 404 along substantially the entire length of the signal contacts 404 between the mating end 408 and the mounting end 410. In an exemplary embodiment, the shield structure 406 is configured to be electrically connected to the mating electrical connector and/or the circuit board 104. The shield structure 406 may be electrically connected to the circuit board 104 by features, such as grounding pins and/or surface tabs.

The housing 400 is manufactured from a dielectric material, such as a plastic material, and provides isolation between the signal contacts 404 and the shield structure 406. The housing 400 isolates each set (for example, differential pair) of signal contacts 404 from other sets of signal contacts 404.

Figure 3:
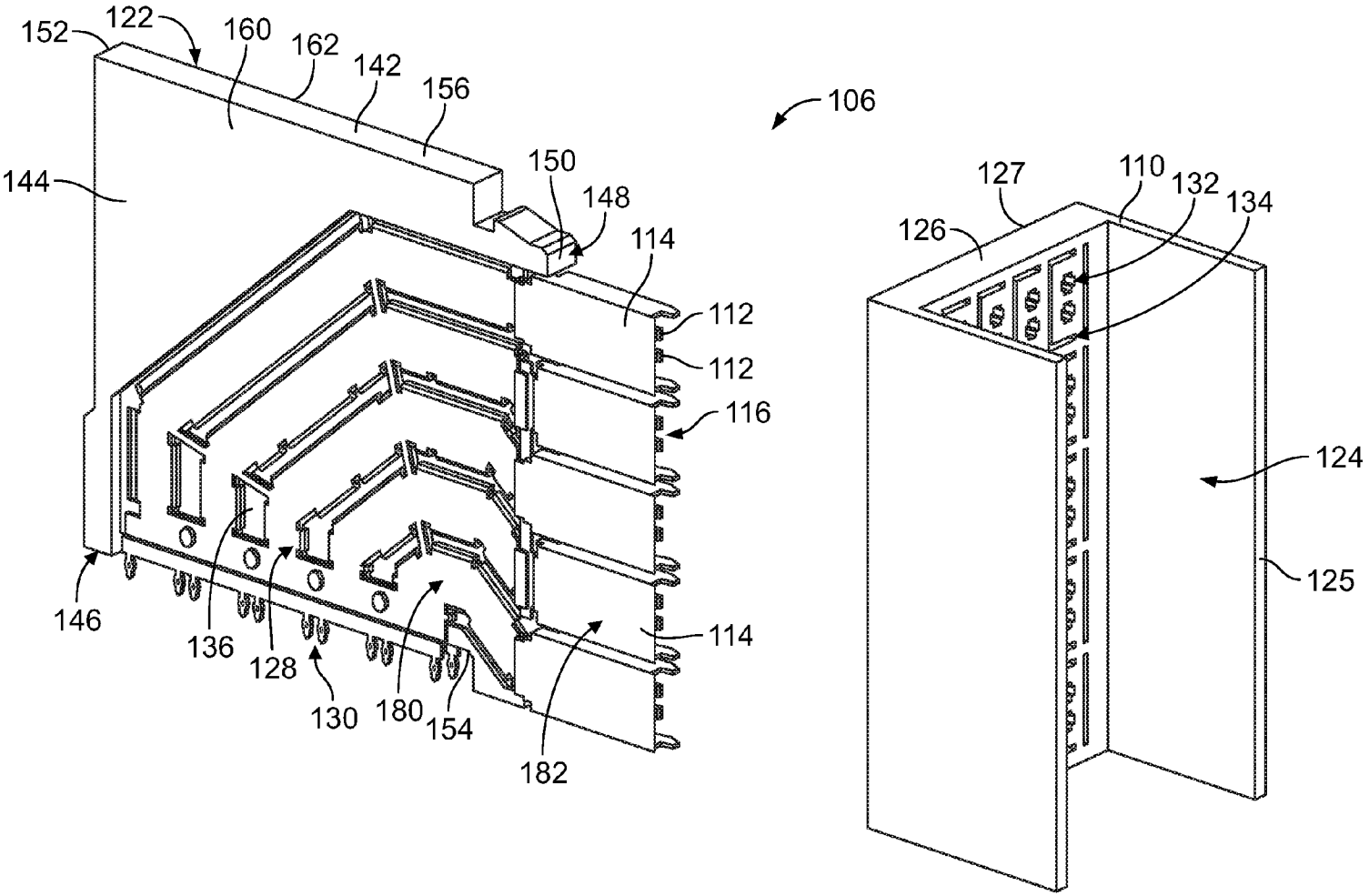
FIG. 3 is a front perspective view of a portion of the electrical connector showing a contact module in accordance with an exemplary embodiment.
Figure 4:
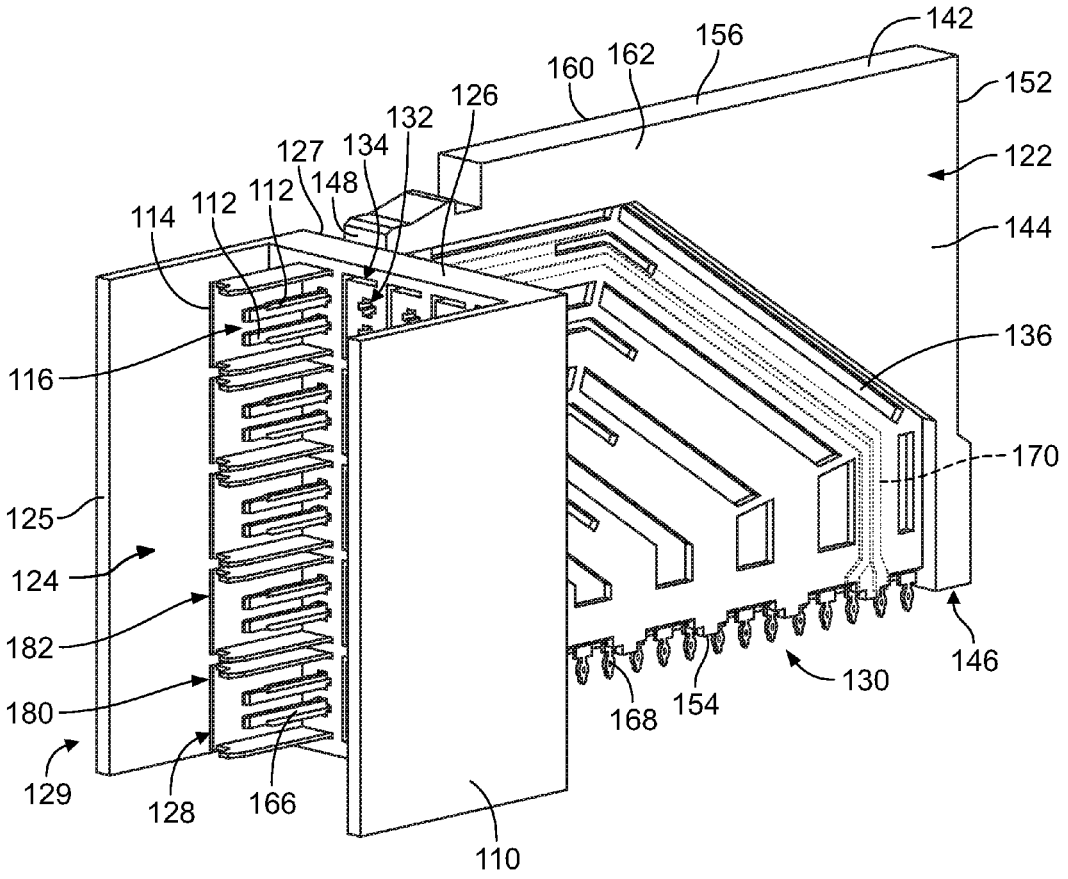
FIG. 4 is a front perspective view of a portion of the electrical connector showing the contact module.

FIG. 3 is a front perspective view of a portion of the electrical connector 106 showing one of the contact modules 122 poised for loading into the housing 110. FIG. 4 is a front perspective view of a portion of the electrical connector 106 showing one of the contact modules 122 coupled to the housing 110.

In an exemplary embodiment, the housing 110 includes a chamber 124 at a front 125 of the housing 110 and a base 126 at a rear 127 of the housing 110. The chamber 124 is open at the front 125 to receive the electrical connector 102. The contact modules 122 are coupled to the base 126 at the rear 127 and extend rearward from the housing 110. The signal contacts 112 and the ground hoods 114 pass through the base 126 into the chamber 124 for mating with the mating electrical connector 102.

The signal contacts 112 are arranged in a matrix of rows and columns. Any number of signal contacts 112 may be provided in the rows and columns. Optionally, the signal contacts 112 may be arranged with the pairs 116 arranged in columns (pair-in-column signal contacts). Alternatively, the pairs 116 of signal contacts 112 may be arranged in rows (pair-in-row signal contacts). The signal contacts 112 within each pair may be contained within the same contact module 122.

In an exemplary embodiment, each contact module 122 has a shield structure 128 for providing electrical shielding for the signal contacts 112. The shield structure 128 is configured to be electrically connected to the circuit board 108 and to the mating electrical connector 102. The shield structure 128 may provide shielding from electromagnetic interference (EMI) and/or radio frequency interference (RFI), and may provide shielding from other types of interference as well to better control electrical characteristics, such as impedance, cross-talk, and the like, of the signal contacts 112. The contact modules 122 provide shielding for each pair of signal contacts 112 along substantially the entire length of the signal contacts 112 between a mating end 129 and a mounting end 130 of the electrical connector 106. The shield structure 128 may be electrically connected to the circuit board 108 by features, such as grounding pins and/or surface tabs.

The housing 110 includes a plurality of signal contact openings 132 and a plurality of ground contact openings 134 through the base 126. The signal contacts 112 are received in corresponding signal contact openings 132. Optionally, a single signal contact 112 is received in each signal contact opening 132. In the illustrated embodiment, the ground contact openings 134 are C-shaped and receive corresponding ground hoods 114. For example, the ground hoods 114 and the mating portions of the signal contacts 112 are loaded through the base 126 of the housing 110 as the contact module 122 is coupled to the housing 110. The housing 110 is manufactured from a dielectric material, such as a plastic material, and provides isolation between the signal contact openings 132 and the ground contact openings 134. The housing 110 isolates the signal contacts 112 from the shield structure 128. The housing 110 isolates each set (for example, differential pair) of signal contacts 112 from other sets of signal contacts 112.

The signal contacts 112 are arranged in an array with ground contacts or guard traces 136 in a contact plane. In an exemplary embodiment, the signal contacts 112 and the guard traces 136 are stamped and formed from a common sheet of metal, such as a leadframe. The guard traces 136 are coplanar with the signal contacts 112. The guard traces 136 are arranged between corresponding signal contacts 112, such as between the pairs 116 of the signal contacts 112. The guard traces 136 form part of the shield structure 128. The guard traces 136 provide electrical shielding between the signal contacts 112, such as between the pairs 116 of the signal contacts 112.

The contact module 122 includes a dielectric holder 142 holding the signal contacts 112 and the guard traces 136. The dielectric holder 142 generally surrounds the signal contacts 112 and the guard traces 136 along substantially the entire lengths thereof between a mounting end 146 at the bottom of the dielectric holder 142 and a mating end 148 at the front of the dielectric holder 142. The shield structure 128 is held by and/or configured to be coupled to the dielectric holder 142 to provide electrical shielding for the signal contacts 112. The shield structure 128 provides circumferential shielding for each pair 116 of signal contacts 112 along at least a majority of a length of the signal contacts 112, such as substantially an entire length of the signal contacts 112.

The dielectric holder 142 is formed from a dielectric body 144 at least partially surrounding the signal contacts 112 and the guard traces 136. The dielectric body 144 may be overmolded over the signal contacts 112 and the guard traces 136. Portions of the signal contacts 112 and the guard traces 136 are encased in the dielectric body 144. The dielectric holder 142 has a front 150 configured to be coupled to the housing 110, a rear 152 opposite the front 150, a bottom 154 which optionally may be adjacent to the circuit board 108 (shown in FIG. 1), and a top 156 generally opposite the bottom 154. The dielectric holder 142 also includes first and second sides 160, 162, such as a right side 160 and a left side 162.

In an exemplary embodiment, portions of the shield structure 128 (such as the guard traces 136) are at least partially encased in the dielectric body 144, while other portions of the shield structure 128 are coupled to the exterior of the dielectric body 144, such as the right side 160 and/or the left side 162 of the dielectric holder 142. In the illustrated embodiment, the guard traces 136 are arranged along the contact plane between, and optionally parallel to, the first and second sides 160, 162.

Each signal contact 112 has a mating portion 166 extending forward from the front 150 of the dielectric holder 142 and a mounting portion 168 extending downward from the bottom 154. Each signal contact 112 has a transition portion 170 (shown in phantom) between the mating and mounting portions 166, 168. The mating portions 166 are configured to extend into the chamber 124 of the housing 110 for electrical connection with the corresponding signal contacts 404 (shown in FIG. 2) when the electrical connector 106 is mated to the mating electrical connector 102 (shown in FIG. 1). In an exemplary embodiment, the mounting portions 168 include compliant pins, such as eye-of-the-needle pins, configured to be terminated to the circuit board 108 (shown in FIG. 1).

In an exemplary embodiment, the shield structure 128 includes first and second ground shields 180, 182. The first and second ground shields 180, 182 are each separate stamped and formed pieces configured to be mechanically and electrically connected together to form part of the shield structure. The first and second ground shields 180, 182 are configured to be electrically connected to the guard traces 136 to electrically common all of the components of the shield structure 128. The first and second ground shields 180, 182 cooperate to provide shielding along the mating portions 166 of the signal contacts 112. In an exemplary embodiment, the first and second ground shields 180, 182 are positioned along the right side 160 of the dielectric holder 142; however, other positions are possible in alternative embodiments. The first and second ground shields 180, 182 electrically connect the contact module 122 to the electrical connector 102. The first ground shield 180 electrically connects the contact module 122 to the circuit board 108, such as through compliant pins thereof.

Figure 5:
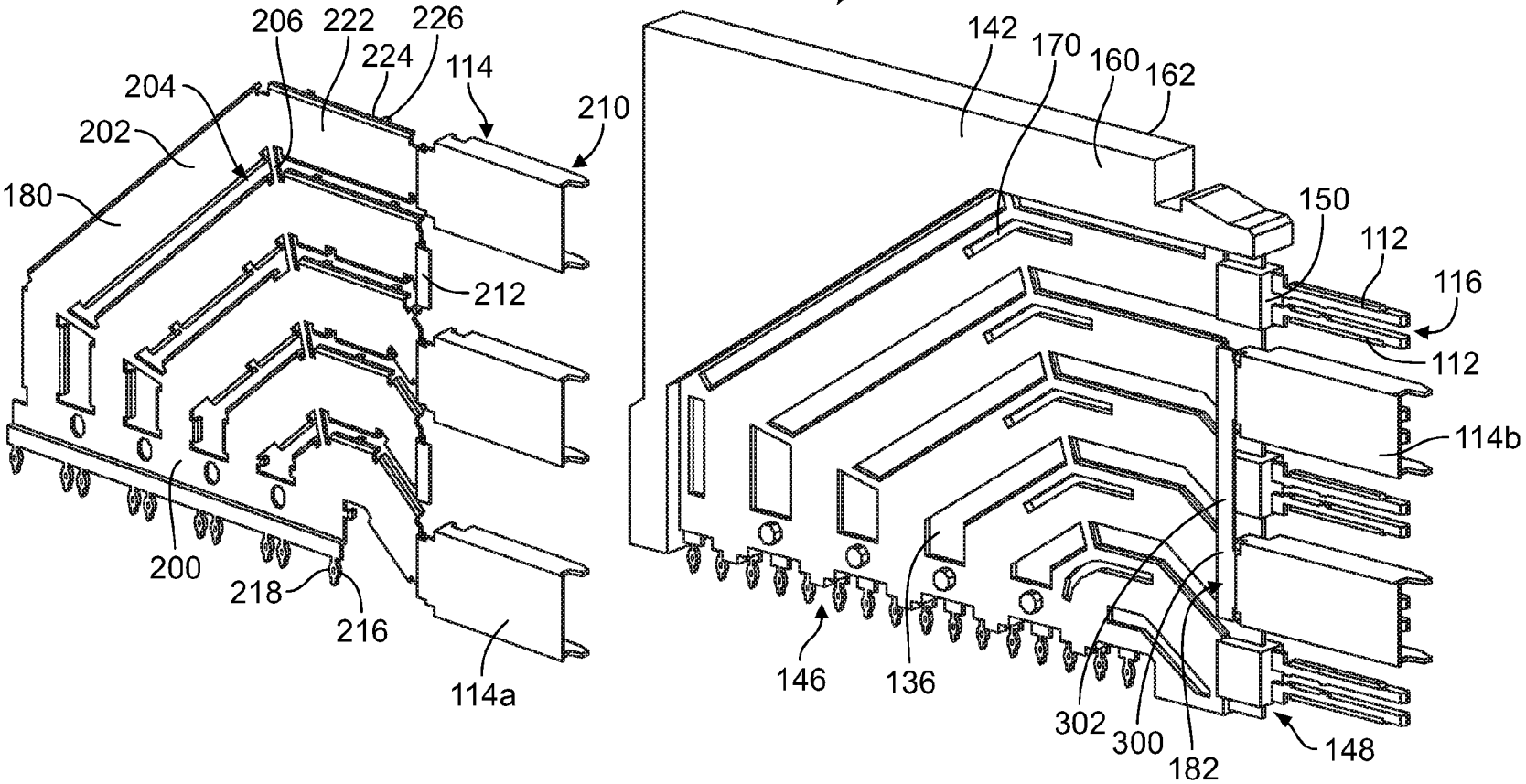
FIG. 5 is an exploded view of the contact module showing ground shields thereof.

FIG. 5 is an exploded view of the contact module 122 showing the second ground shield 182 coupled to the dielectric holder 142 and the first ground shield 180 poised for coupling to the dielectric holder 142 and the second ground shield 182. In alternative embodiments, the first ground shield 180 may be coupled to the dielectric holder 142 prior to the second ground shield 182. In other various embodiments, other ground shields may be provided, such as ground shields defining different ground hoods 114.

The first ground shield 180 is stamped and formed from a stock piece of metal material. In an exemplary embodiment, the first ground shield 180 includes a main body 200 configured to extend along the right side 160 of the dielectric holder 142 (although the first ground shield 180 may be reversed and designed to extend along the left side 162 in other various embodiments). The main body 200 includes a plurality of rails 202 separated by gaps 204, the rails 202 being interconnected by connecting strips 206 that span the gaps 204 between the rails 202. The rails 202 are configured to extend along and follow the paths of the signal contacts 112, such as between the mating end 148 and the mounting end 146. The rails 202 and corresponding ground hoods 114 are stamped and formed from the main body 200 such that the rails 202 and the ground hoods 114 are part of a unitary one-piece body.

The first ground shield 180 includes mating portions 210 defined by the ground hoods 114 or connecting tabs 212 at the mating end of the main body 200. The ground hoods 114 are configured to be mated with corresponding mating portions of the electrical connector 102. In an exemplary embodiment, every other rail 202 includes a ground hood 114*a*, while the intermediary rails 202 are devoid of ground hoods 114, but rather include connecting tabs 212. For example, the first ground shield 180 has insufficient spacing between the rails 202 to form ground hoods 114 on every rail 202 because of the tight spacing of the signal pairs and the overall height of the electrical connector 106. Because the first ground shield 180 has insufficient material to form all of the ground hoods 114, such as to form the end walls 118*b*, 118*c*, gaps are provided between some of the ground hoods 114*a*. The second ground shield 182 includes other ground hoods 114*b* to fill in the gaps between the ground hoods 114*a* of the first ground shield 180.

The first ground shield 180 includes mounting portions 216 defined by compliant pins 218 at the mounting end of the main body 200. The mounting portions 216 are configured to be terminated to the circuit board 108 (shown in FIG. 1). For example, the mounting portions 216 are configured to be received in plated vias in the circuit board 108.

The rails 202 are configured to provide shielding along the sides of the signal contacts 112 of the corresponding pair 116. For example, in an exemplary embodiment, the rails 202 have side strips 222 configured to extend along the right side 160 of the dielectric holder 142 and connecting strips 224 configured to extend into the dielectric holder 142 and extend between corresponding signal contacts 112. The side strips 222 generally follow the paths of the transition portions 170 of the signal contacts 112. The side strips 222 provide shielding along the sides of the pair 116 of signal contacts 112.

The connecting strips 224 extend into the dielectric holder 142 to directly engage the guard traces 136. The connecting strips 224 are bent perpendicular to and extend from the corresponding side strips 222. Optionally, the connecting strips 224 may be provided along both the top and the bottom of the side strips 222. Alternatively, the connecting strips 224 may be provided along only the top or only the bottom. In an exemplary embodiment, each connecting strip 224 includes one or more commoning features 226 for electrically connecting the ground shield 180 to the guard trace 136. In the illustrated embodiment, the commoning features 226 are commoning tabs, and may be referred to hereinafter as commoning tabs 226, which extend outward from the connecting strips 224; however, other types of commoning features may be used in alternative embodiments, such as channels, slots, spring beams, and the like. Optionally, each connecting strip 224 includes at least one commoning tab 226. As such, each rail 202 has multiple points of contact with the corresponding guard trace 136.

The second ground shield 182 is stamped and formed from a stock piece of metal material. The second ground shield 182 includes a main body 300 configured to extend along the right side 160 of the dielectric holder 142. The main body 300 is configured to attach to the front 150 of the dielectric holder 142; however, the main body 300 may extend between the mating end 148 and the mounting end 146 in other various embodiments, similar to the first ground shield 180. The ground shield 182 includes a connecting strip 302 between corresponding ground hoods 114*b* to control the spacing therebetween. Optionally, the connecting tabs 212 of the first ground shield 180 may be terminated to the connecting strip 302, such as by welding or an interference connection.

The ground shield 182 includes a plurality of ground hoods 114*b* at the mating end of the main body 300. The ground hoods 114*b* are configured to be mated with corresponding mating portions of the mating electrical connector 102. The ground hoods 114*b* are positioned between corresponding ground hoods 114*a* of the first ground shield 180. The ground hoods 114*b* may be sized and shaped identical to the ground hoods 114*a*. Optionally, both sets of ground hoods 114*a*, 114*b* may be stamped and formed from a common blank, later separated from each other and then separately mounted to the dielectric holder 142.

Figure 6:
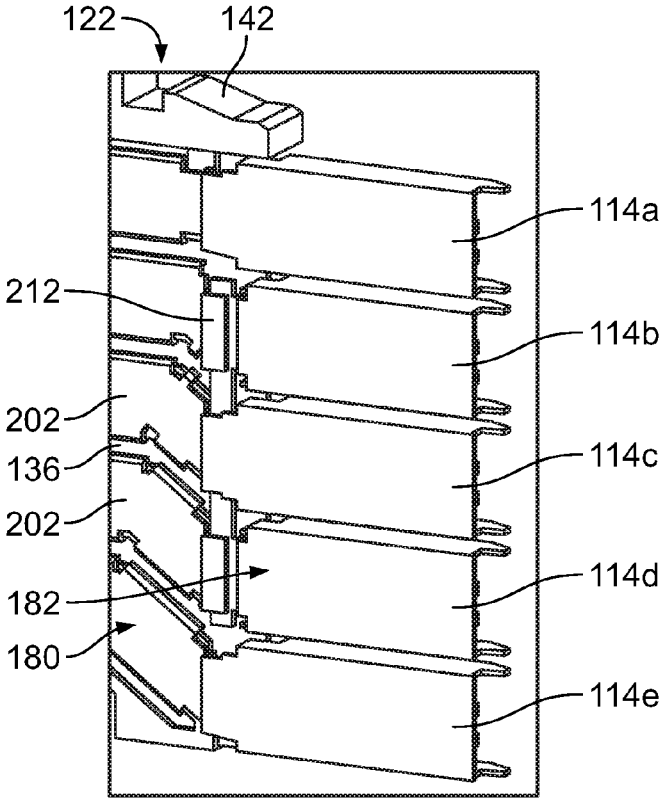
FIG. 6 is a perspective view of a portion of the contact module in an assembled state.
Figure 7:
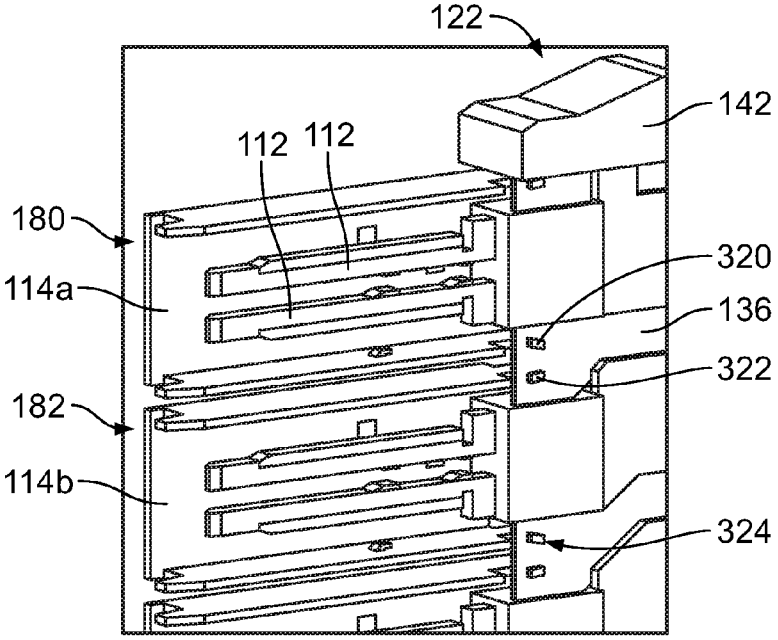
FIG. 7 is another perspective view of a portion of the contact module in an assembled state.

FIG. 6 is a perspective view of a portion of the contact module 122 in an assembled state. FIG. 7 is another perspective view of a portion of the contact module 122 in an assembled state. The first and second ground shields 180, 182 are coupled to the dielectric holder 142. The contact module 122 includes five rails 202 and five ground hoods 114 corresponding to the five pairs of signal contacts 112; however, the contact module 122 may include any number of ground hoods 114. In the illustrated embodiment, the first, third and fifth ground hoods 114*a*, 114*c*, 114*e* (from the top) are part of the first ground shield 180, while the second and fourth ground hoods 114*b*, 114*d* (from the top) are part of the second ground shield 182. The second ground hood 114*b* is positioned between the first and third ground hoods 114*a*, 114*c*. The third ground hood 114*c* is positioned between the second and fourth ground hoods 114*b*, 114*d*.

The ground shields 180, 182 are electrically connected to the corresponding guard traces 136. For example, connecting tabs 320, 322 extend from the ground hoods 114 of the first and second ground shields 180, 182, respectively, which are received in openings 324 in the guard traces 136. The connecting tabs 320, 322 may be terminated to the guard traces 136 by interference connections, solder connections or other types of connections. Optionally, the connecting tabs 212 may be terminated to the second ground shield 182, such as by a solder connection.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f) unless and until such claim limitations expressly use the phrase "means for" followed by a statement of function void of further structure.

What is claimed is:

1. An electrical connector comprising:

a housing having a front and a rear opposite the front, the housing having a chamber at the front for receiving a mating electrical connector, the housing having a base at the rear defining a back of the chamber, the base having signal contact openings therethrough, the base having ground contact openings therethrough; and a contact module stack having a plurality of contact modules coupled to the base and extending rearward from the rear of the housing, each contact module comprising:

a dielectric holder holding signal contacts, the signal contacts having mating portions extending from a mating end of the dielectric holder, mounting portions extending from a mounting end of the dielectric holder for termination to a circuit board, and transition portions between the mating portions and the mounting portions, the mating portions being received in corresponding signal contact openings and extending into the chamber for mating with the mating electrical connector; and a ground shield coupled to the dielectric holder and providing electrical shielding for the signal contacts, the ground shield having a plurality of rails configured to be aligned with the transition portions of corresponding signal contacts, wherein at least two of the rails have ground hoods extending forward of the mating end of the dielectric holder along the mating portions of the signal contacts, the ground hoods being received in corresponding ground contact openings and extending into the chamber for mating with the mating electrical connector.

2. The electrical connector of claim 1, wherein the ground hoods and the mating portions of the signal contacts are loaded through the base of the housing as the contact module is coupled to the housing.

3. The electrical connector of claim 1, wherein the ground hoods surround the corresponding signal contacts on three sides thereof.

4. The electrical connector of claim 1, wherein the ground hoods are C-shaped having a center wall and a pair of end walls extending from opposite ends of the center wall.

5. The electrical connector of claim 1, wherein the ground shield has a main body, the rails and corresponding ground hoods are stamped and formed from the main body such that the rails and the ground hoods are part of a unitary one-piece body.

6. The electrical connector of claim 1, wherein the ground shield is a first ground shield, and wherein the ground hoods include a first ground hood and a second ground hood, the contact module further comprising a second ground shield coupled to the dielectric holder, the second ground shield having a third ground hood positioned between the first and second ground hoods.

7. The electrical connector of claim 6, wherein the second ground shield further comprises a fourth ground hood formed integral with the third ground hood, the second ground hood being positioned between the third and fourth ground hoods.

8. The electrical connector of claim 6, wherein one of the rails includes a connecting tab, the connecting tab being terminated to the third ground hood.

9. The electrical connector of claim 1, wherein the signal contacts are arranged in pairs, each ground hood surrounding a corresponding pair of the signal contacts.

10. The electrical connector of claim 1, further comprising guard traces held by the dielectric holder between corresponding signal contacts and providing electrical shielding between corresponding signal contacts, the rails electrically commoning each of the guard traces.

11. The electrical connector of claim 10, wherein the ground hoods include connecting tabs being electrically connected to the corresponding guard traces.

12. An electrical connector comprising:

a housing having a front and a rear opposite the front, the housing having a chamber at the front for receiving a mating electrical connector, the housing having a base at the rear defining a back of the chamber, the base having signal contact openings therethrough, the base having ground contact openings therethrough;

a contact module stack having a plurality of contact modules coupled to the base and extending rearward from the rear of the housing, each contact module comprising:

a dielectric holder having first and second sides extending between a mating end and a mounting end;

signal contacts being held by the dielectric holder along a contact plane defined between the first and second sides, the signal contacts having mating portions extending from the mating end, mounting portions extending from the mounting end for termination to a circuit board, and transition portions extending through the dielectric holder between the mating portions and the mounting portions, the mating portions being received in corresponding signal contact openings and extending into the chamber for mating with the mating electrical connector;

guard traces being held by the dielectric holder along the contact plane between corresponding signal contacts, the guard traces being electrically commoned and providing electrical shielding between the corresponding signal contacts; and a ground shield coupled to the first side of the dielectric holder and providing electrical shielding for the signal contacts, the ground shield being electrically connected to each of the guard traces, the ground shield having a plurality of rails for electrically shielding corresponding signal contacts, each of the rails having side strips configured to be aligned with the transition portions of corresponding signal contacts along the first side, each of the rails having connecting strips extending inward from the side strips into the dielectric holder to directly engage the corresponding guard traces, wherein at least two of the rails have ground hoods extending along the mating ends of the signal contacts, the ground hoods being received in corresponding ground contact openings and extending into the chamber for mating with the mating electrical connector.

13. The electrical connector of claim 12, wherein the ground hoods are C-shaped having a center wall and a pair of end walls extending from opposite ends of the center wall to surround the corresponding signal contacts on three sides thereof.

14. The electrical connector of claim 12, wherein the ground shield has a main body, the rails and corresponding ground hoods are stamped and formed from the main body such that the rails and the ground hoods are part of a unitary one-piece body.

15. The electrical connector of claim 12, wherein the ground shield is a first ground shield, and wherein the ground hoods include a first ground hood and a second ground hood, the contact module further comprising a second ground shield coupled to the dielectric holder, the second ground shield having a third ground hood positioned between the first and second ground hoods.

16. The electrical connector of claim 15, wherein the second ground shield further comprises a fourth ground hood formed integral with the third ground hood, the second ground hood being positioned between the third and fourth ground hoods.

17. The electrical connector of claim 15, wherein one of the rails includes a connecting tab, the connecting tab being terminated to the third ground hood.

18. An electrical connector comprising:

a housing having a front and a rear opposite the front, the housing having a chamber at the front for receiving a mating electrical connector, the housing having a base at the rear defining a back of the chamber, the base having signal contact openings therethrough, the base having ground contact openings therethrough;

a contact module stack having a plurality of contact modules coupled to the base and extending rearward from the rear of the housing, each contact module comprising:

a dielectric holder having first and second sides extending between a mating end and a mounting end;

signal contacts being held by the dielectric holder along a contact plane defined between the first and second sides, the signal contacts having mating portions extending from the mating end, mounting portions extending from the mounting end for termination to a circuit board, and transition portions extending through the dielectric holder between the mating portions and the mounting portions, the mating portions being received in corresponding signal contact openings and extending into the chamber for mating with the mating electrical connector;

guard traces being held by the dielectric holder along the contact plane between corresponding signal contacts, the guard traces being electrically commoned and providing electrical shielding between the corresponding signal contacts;

a first ground shield coupled to the first side of the dielectric holder and providing electrical shielding for the signal contacts, the first ground shield being electrically connected to each of the guard traces, the first ground shield having a plurality of rails for electrically shielding corresponding signal contacts, the plurality of rails including, in order, a first rail, a second rail and a third rail, each of the rails having side strips configured to be aligned with the transition portions of corresponding signal contacts along the first side, wherein the first and third rails have ground hoods extending along the mating ends of the signal contacts and the second rail does not include a ground hood; and a second ground shield coupled to the first side of the dielectric holder and providing electrical shielding, the second ground shield having a ground hood extending forward of the second rail, the second rail being terminated to the ground hood of the second ground shield;

wherein the ground hood associated with the first rail is a first ground hood, the ground hood of the second ground shield associated with the second ground rail is a second ground hood, and the ground hood associated with the third rail is a third ground hood, the second ground hood being positioned between the first and the third ground hoods, the first, second and third ground hoods being received in corresponding ground contact openings and extending into the chamber for mating with the mating electrical connector.

19. The electrical connector of claim 12, wherein the ground hoods are C-shaped having a center wall and a pair of end walls extending from opposite ends of the center wall to surround the corresponding signal contacts on three sides thereof.

20. The electrical connector of claim 15, wherein the second ground shield further comprises a fourth ground hood formed integral with the second ground hood and being terminated to a fourth rail of the first ground shield, the third ground hood being positioned between the second and fourth ground hoods.

* * * * *